US010189024B2

(12) United States Patent
Aberg et al.

(10) Patent No.: US 10,189,024 B2
(45) Date of Patent: Jan. 29, 2019

(54) GYRATORY CRUSHER FRAME

(71) Applicant: SANDVIK INTELLECTUAL PROPERTY AB, Sandviken (SE)

(72) Inventors: Niklas Aberg, Sodra Sandby (SE); Axel Bergman, Malmo (SE); Gustav Bern, Kalmar (SE); Bengt-Arne Eriksson, Svedala (SE); Mikael M Larsson, Eslov (SE); Patric Malmqvist, Svedala (SE)

(73) Assignee: SANDVIK INTELLECTUAL PROPERTY AB, Sandviken (SE)

( * ) Notice: Subject to any disclaimer, the term of this patent is extended or adjusted under 35 U.S.C. 154(b) by 306 days.

(21) Appl. No.: 14/390,128

(22) PCT Filed: Mar. 18, 2013

(86) PCT No.: PCT/EP2013/055546
§ 371 (c)(1),
(2) Date: Oct. 2, 2014

(87) PCT Pub. No.: WO2013/149814
PCT Pub. Date: Oct. 10, 2013

(65) Prior Publication Data

US 2015/0060584 A1 Mar. 5, 2015

(30) Foreign Application Priority Data

Apr. 3, 2012 (EP) ..... 12162974

(51) Int. Cl.
*B02C 2/04* (2006.01)
*B02C 2/06* (2006.01)
*B02C 2/00* (2006.01)
*B02C 2/02* (2006.01)

(52) U.S. Cl.
CPC ..... *B02C 2/06* (2013.01); *B02C 2/00* (2013.01); *B02C 2/02* (2013.01); *B02C 2/04* (2013.01)

(58) Field of Classification Search
CPC .... B02C 2/06; B02C 2/04; B02C 2/00; B02C 2/02
USPC ..... 241/207–216, 285.1
See application file for complete search history.

(56) References Cited

U.S. PATENT DOCUMENTS 3,809,324 A * 5/1974 Cook ..... B02C 2/06 241/210
4,034,922 A 7/1977 Coxhill
4,037,800 A * 7/1977 Coxhill ..... B02C 2/06 241/213

(Continued)

FOREIGN PATENT DOCUMENTS

GB 269866 A 9/1927
GB 322690 A 12/1929
WO 2004110626 A1 12/2004

*Primary Examiner* — Anthony Stashick
*Assistant Examiner* — Onekki Jolly
(74) *Attorney, Agent, or Firm* — Corinne R. Gorski

(57) ABSTRACT

A gyratory crusher frame part and a gyratory crusher include a topshell and spider assembly configured to minimize stress concentrations. An annular flange is formed at the junction between a lower region of each spider arm and an upper region of the topshell. Optimization of loading force transfer and a reduction in stress concentration is achieved by positioning the spider arms radially inward relative to an outer circumferential perimeter of the flange.

11 Claims, 6 Drawing Sheets

(56) References Cited

U.S. PATENT DOCUMENTS

| | | | | | |
|---|---|---|---|---|---|
| 4,060,205 | A * | 11/1977 | Pollak | B02C 2/047 | 138/26 |
| 4,065,064 | A * | 12/1977 | Anthony | B02C 2/005 | 241/182 |
| 4,339,087 | A * | 7/1982 | Pollak | B02C 2/06 | 241/207 |
| 4,410,143 | A * | 10/1983 | Polinski | B02C 2/06 | 241/209 |
| 7,036,758 | B2 * | 5/2006 | Hamada | B02C 2/005 | 241/207 |
| 8,070,084 | B2 * | 12/2011 | Biggin | B02C 2/06 | 241/209 |
| 2002/0170994 | A1 | 11/2002 | Van Mullem | | |
| 2010/0155512 | A1 | 6/2010 | Persson | | |
| 2011/0192927 | A1 * | 8/2011 | Biggin | B02C 2/06 | 241/213 |
| 2011/0290925 | A1 * | 12/2011 | Johansson | B02C 2/06 | 241/216 |

* cited by examiner

GYRATORY CRUSHER FRAME

RELATED APPLICATION DATA

This application is a § 371 National Stage Application of PCT International Application No. PCT/EP2013/055546 filed Mar. 18, 2013 claiming priority of EP Application No. 12162974.5, filed Apr. 3, 2012.

TECHNICAL FIELD OF INVENTION

The present invention relates to a gyratory crusher frame part and in particular, although not exclusively to a topshell and spider assembly forming an upper region of the crusher frame.

BACKGROUND OF THE INVENTION

Gyratory crushers are used for crushing ore, mineral and rock material to smaller sizes. Referring to FIG. 1, a typical crusher comprises a frame 100 having an upper frame 101 and a lower frame 102. A crushing head 103 is mounted upon an elongate shaft 107. A first crushing shell 105 is fixably mounted on crushing head 103 and a second crushing shell 106 is fixably mounted at top frame 101. A crushing zone 104 is formed between the opposed crushing shells 105, 106. A discharge zone 109 is positioned immediately below crushing zone 104 and is defined, in part, by lower frame 102.

Upper frame 101 may be further divided into a topshell 111, mounted upon lower frame 102 (alternatively termed a bottom shell), and a spider 114 that extends from topshell 111 and represents an upper portion of the crusher. Spider 114 comprises two diametrically opposed arms 110 that extend radially outward from a central cap 112 positioned on a longitudinal axis 115 extending through frame 100 and the gyratory crusher generally. Arms 110 are attached to an upper region of topshell 111 via an intermediate annular flange 113 that is centred around longitudinal axis 115. Typically, arms 110 and topshell 111 form a unitary structure and are formed integrally.

A drive (not shown) is coupled to main shaft 107 via a drive shaft 108 and suitable gearing 116 so as to rotate shaft 107 eccentrically about longitudinal axis 115 and to cause crushing head 103 to perform a gyratory pendulum movement and crush material introduced into crushing gap 104.

Example gyratory crushers having the aforementioned topshell and spider assembly are described in U.S. Pat. No. 2,832,547; US 2002/017994; WO 2004/110626 and US 2011/0192927.

In order to maximise the opening into the crushing zone, it is conventional for the spider arms 110 to extend from the annular flange 113 at the flange outermost perimeter. As the flange 113 extends radially outward beyond the circumferential wall of the topshell 111, reinforcements are typically required on the external facing surface of the topshell walls being positioned directly below the spider arms 111.

These reinforcing ribs that act to transmit the axial forces imparted onto the topshell 111 from spider 110 are necessary due to the non-optimised alignment of the spider arms 111 and the circumferential wall of the topshell. These ribs are disadvantageous as they both add additional weight to the crusher and increase complexity of manufacturing.

Accordingly, what is required is a gyratory crusher frame that addresses the above problem.

SUMMARY OF THE INVENTION

It is an object of the present invention to provide a gyratory crusher frame and a gyratory crusher that is both more convenient to manufacture, is more lightweight and minimises the creation of stress concentrations in the frame during operation resultant, in part, from the transfer of loading forces through the crusher.

The object is achieved by specifically positioning and aligning the spider arms at the intermediate flange and topshell. In particular, the inventors have identified that by positioning the spider arms radially inward from an outer circumferential perimeter of the flange that connects the spider to the topshell, the transfer of loading forces between the spider and the topshell is more direct and the need for additional reinforcement ribs below the spider arms is avoided. Accordingly, longitudinal forces are transmitted from the spider arms to the topshell with minimal stress concentrations created in the topshell wall in contrast to conventional reinforced spider and topshell assemblies.

According to a first aspect of the present invention there is provided a gyratory crusher frame part comprising: a topshell mountable upon a bottom shell, the topshell having an annular wall extending around a longitudinal axis of the frame part; a spider having a plurality of arms extending radially outward from a cap positioned at the longitudinal axis, each arm of the plurality of arms having a first portion extending generally in a radially outward direction from the cap and a second portion extending generally in an axial direction from an outer region of the first portion; an annular flange positioned between the second portion of each arm and the annular wall, the flange having an outer circumferential perimeter and an inner circumferential perimeter relative to the longitudinal axis; characterised in that: a radially outermost region of the second portion of each arm is positioned radially inward of the outer circumferential perimeter of the flange.

Preferably, the radially outermost region of the second portion of each arm is positioned radially inward of the outer circumferential perimeter by a distance in the range 5 to 50% of the radial distance between the inner and outer circumferential perimeters of the flange.

Preferably, the radially outermost region of the second portion of each arm is positioned radially inward of the outer circumferential perimeter by a distance in the range 15 to 35% of a radial distance between the inner and outer circumferential perimeters of the flange.

Preferably, the radially outermost region of the second portion of each arm is positioned radially inward of the outer circumferential perimeter by a distance in the range 20 to 30% of a radial distance between the inner and outer circumferential perimeters of the flange.

Preferably, the topshell comprises an outward facing surface and an inward facing surface relative to the longitudinal axis, the annular wall being defined between the outward and inward facing surfaces; wherein a section of the wall neighbouring the flange comprises a concave section at the outer surface and a first half of the concave section in the axial direction closest to the flange is a substantially uniform curve extending continuously in the circumferential direction around the longitudinal axis.

Preferably, the outer surface of the wall at the concave section comprises a curvature extending over the range 170 to 185° in the axial direction.

Preferably, the flange extends directly from one end of the concave section such that one end of the curved outer surface terminates at the outer perimeter of the flange.

Preferably, the first half of the concave section in the axial direction closest to the flange is devoid of any axially extending shoulders that would otherwise interrupt the continuous circumferential curve.

Preferably, a majority of a second half of the concave section in the axial direction comprises a curvature profile substantially equal to a curvature profile of the first half in the axial direction.

Preferably, the outward facing surface at the concave section comprises a curve extending continuously in the axial direction over the first half and the second half.

Preferably, each second portion of each arm comprises a pair of wings that taper outwardly in the axial direction from the first portion to the flange.

Preferably, each wing of the pair of wings is aligned to extend substantially in the circumferential direction with the flange; and wherein a distance in the circumferential direction by which each wing of the pair of wings tapers outwardly is substantially equal to a thickness of the first portion of each arm extending in a plane perpendicular to the longitudinal axis.

Preferably, each wing of the pair of wings is aligned to extend substantially in the circumferential direction with the flange; and wherein a circumferential length or distance by which the second portion extends over the flange substantially in the circumferential direction is greater than a corresponding radial thickness of the second portion in the direction between the inner and outer perimeters.

Preferably, an outward facing part of the second portion of each arm is flared radially outward and an inward facing part of the second portion of each arm is flared radially inward at a region of contact with the annular flange; and wherein the second portion of each arm is flared circumferentially outward such that a cross sectional area of the second portion of each arm increases in the axial direction from the first portion to the flange.

According to a second aspect of the present invention there is provided a gyratory crusher comprising a frame part as claimed in any preceding claim.

BRIEF DESCRIPTION OF THE DRAWINGS

The present invention will now be described, by way of example only, and with reference to the accompanying drawings in which.

DETAILED DESCRIPTION OF ONE EMBODIMENT

Figure 1:
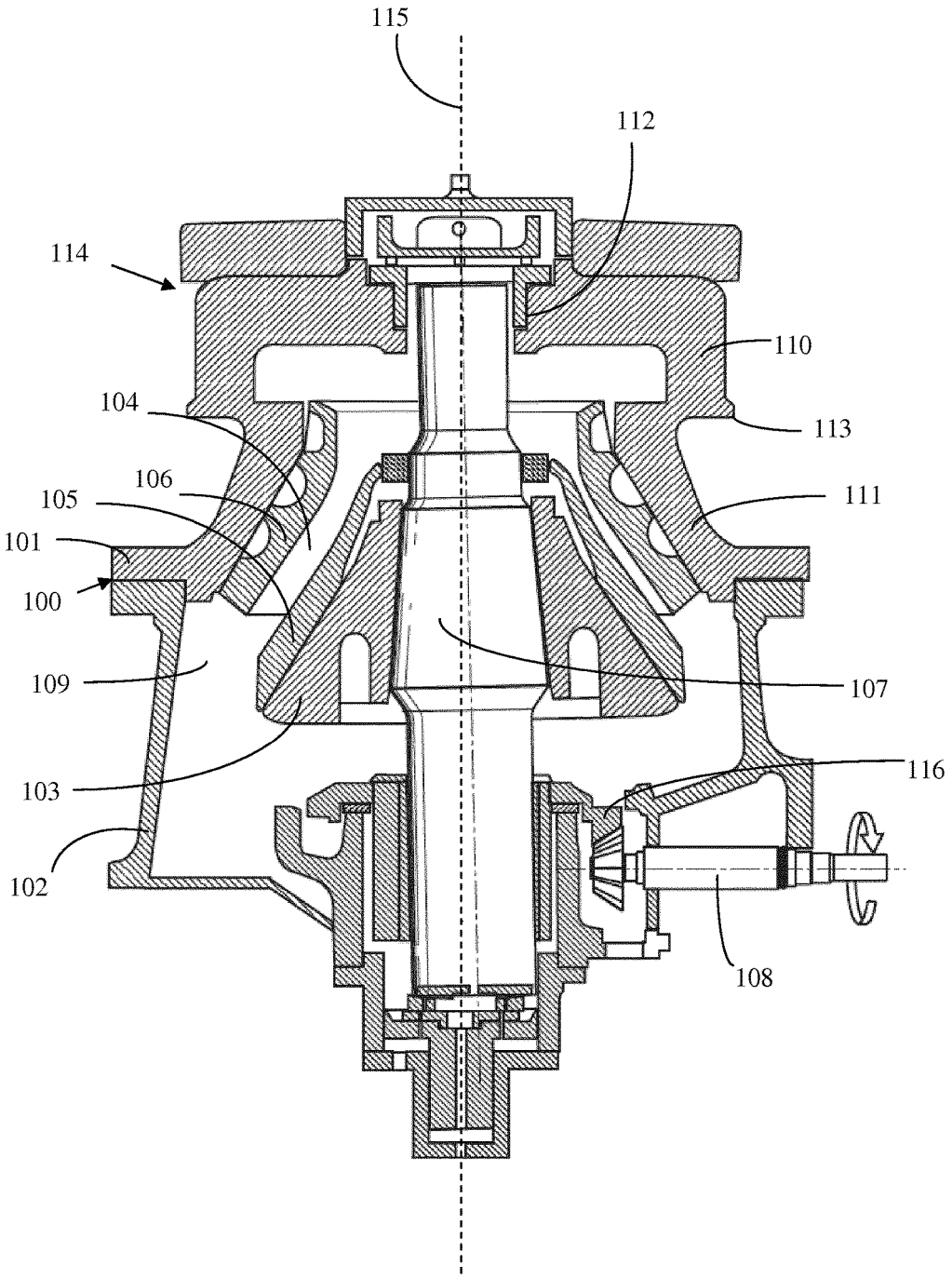
Fig 1 (Prior art)
FIG. 1 is a cross-sectional side view of a prior art gyratory crusher having an upper frame part and a lower frame part, with the upper frame part formed from a topshell and a spider.

The present gyratory crusher and crusher frame assembly comprises those components described with reference to the prior art crusher of FIG. 1 save for the upper frame part 101 formed from spider 110, topshell 111 and intermediate flange 113.

Figure 2:
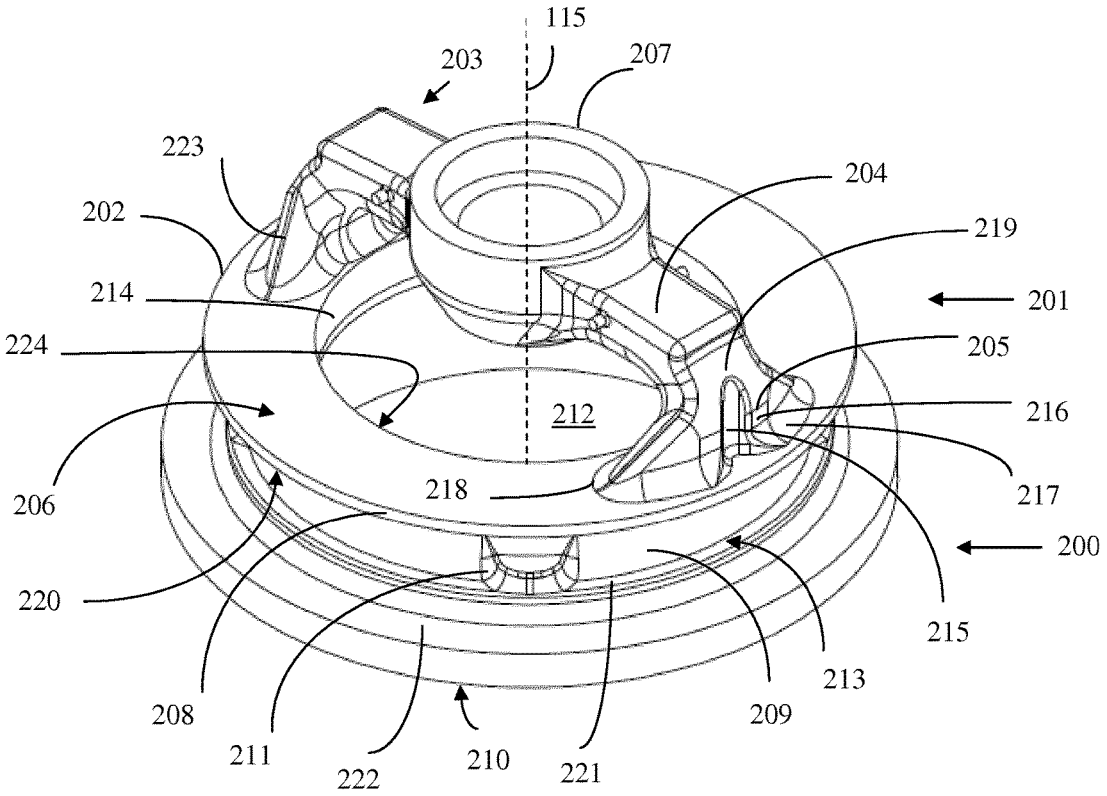
FIG. 2 is a perspective view of a topshell and spider assembly according to a specific implementation of the present invention.

Referring to FIG. 2, the gyratory crusher frame part comprises generally, an annular topshell 200 mounted upon which is a spider 201. Spider 201 comprises two diametrically opposed arms 203 that extend radially outward from central cap or mounting boss 207 positioned centrally about longitudinal axis 115 extending through upper frame part 200, and spider 201 and generally through the gyratory crusher comprising the bottom shell 102, crushing head 103 and elongate shaft 107 as described with reference to FIG. 1.

Arms 203 may be considered to have a radially extending first portion 204 attached to cap 207 and a second portion 205 extending transverse to first portion 204 in a longitudinal direction corresponding to that of axis 115. According to the specific implementation, at least one section of second portion 205 is aligned perpendicular to first portion 204 and is aligned substantially parallel to axis 115. The first and second portions 204, 205 are formed integrally with a junction between the two portions formed from an arcuate section 219 being curved towards central axis 115.

The second lower portion 205 and in particular an outward facing surface 216 represents a radially outermost point, region or surface of each arm 203 relative to longitudinal axis 115. This outermost surface 216, according to the specific implementation, is formed by a section of second region 205 that is aligned parallel to axis 115.

Topshell 200 comprises circumferential walls 213 defined between an external facing surface 209 and an internal facing surface 214. Internal facing surface 214 defines, in part, a central chamber 212 that, in part, defines the crushing zone within which is mounted the crushing head and respective components described with reference to FIG. 1. An annular substantially disc-like flange 202 extends radially outward from an upper end of topshell wall 213. Flange 202 is defined, in part, by an inner circumferential perimeter 224 and an outer circumferential perimeter 208. An upward facing surface 206 extends between perimeters 224 and 208 and is substantially planar and aligned perpendicular to axis 115 and orientated to be facing spider 201. Flange 202 is further defined by an opposed downward facing surface 220 orientated towards topshell 200.

Spider 201 is connected to topshell 200 via flange 202. Lower portion 205 of each arm 203 extends in a transverse or perpendicular alignment to planar surface 206 in a direction of axis 115. So as to spread the loading forces transmitted between spider 201 and topshell 200, the second and lower portion 205 of each arm 203 comprises a pair or wings 223 extending either side of lower portion 205 and in a direction generally following the circumferential path of flange 202. Each wing 223 thereby increases the footprint surface area of each spider arm 203 and its respective surface area contact with upper planar surface 206. In addition to wings 223, second portion 205 (that encompasses wings 223) is flared radially outward and radially inward 217 at respective inward facing surface 700 and outward facing surface 216. Each wing 223 is additionally flared circumferentially outward 218 with these flared sections 217, 218 serving to further increase the footprint size of arms 203 and the surface area contact with surface 206. Flared regions 217, 218 comprise a curvature opposite to a curvature of junction 219 between radial arm portions 204 and axial arm portions 205. Each wing 223 tapers outwardly in a direction from first portion 203 to flange upper surface 206. Additionally, each wing 223 flares outwardly at the region of contact with upper surface 206 both in the radially inward and outward direction 217 and the circumferential direction 218. The second portion 205 of each arm 203 comprises a groove 215 extending axially in the outward facing surface 216. Groove 215 comprises a shape profile suitable to accommodate pipes or other conduits.

Topshell 200 further comprises a lower flange 221 axially separated from upper flange 202 by wall section 213. An annular seating collar 222 is positioned axially below lower flange 221 and comprises a larger diameter than flanges 202, 221 being suitable for mounting upon bottom shell 102 via mounting surface 210 orientated in a downward direction and parallel to upward facing surface 206.

Figure 3:
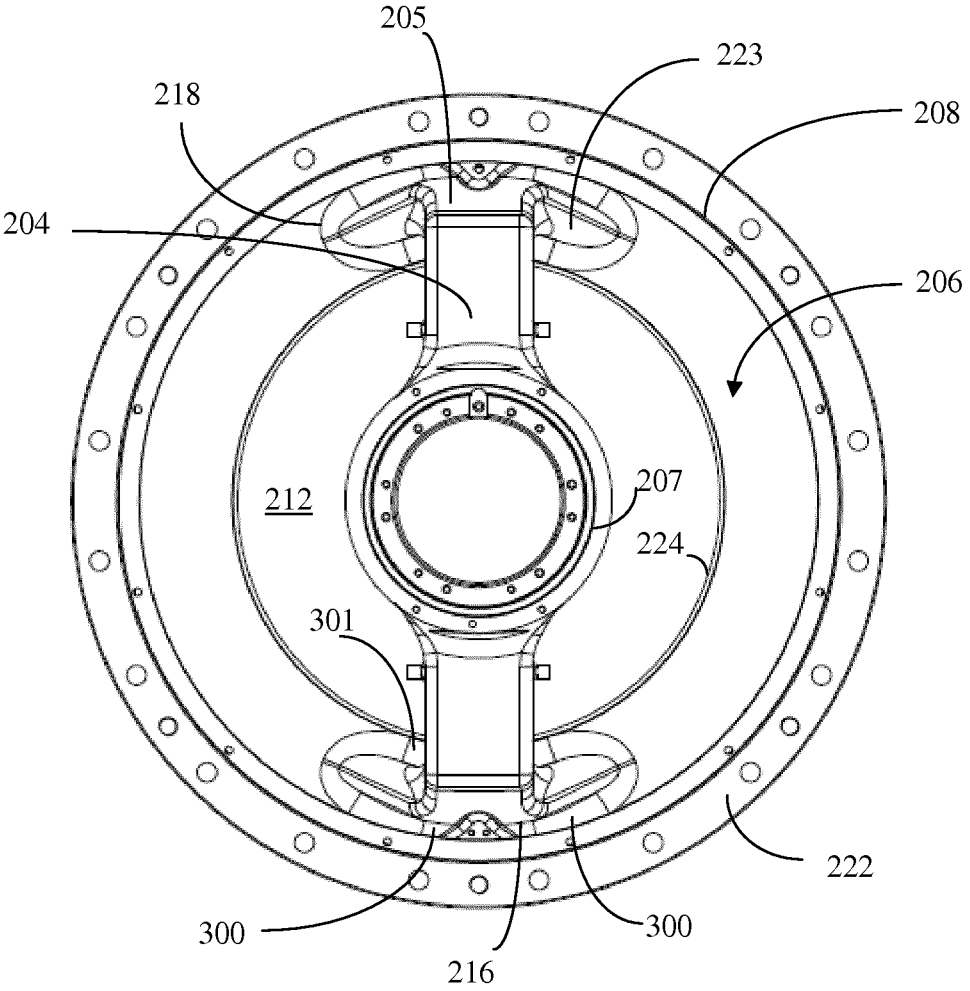
FIG. 3 is a plan view of the spider and topshell assembly of FIG. 2.
Figure 5:
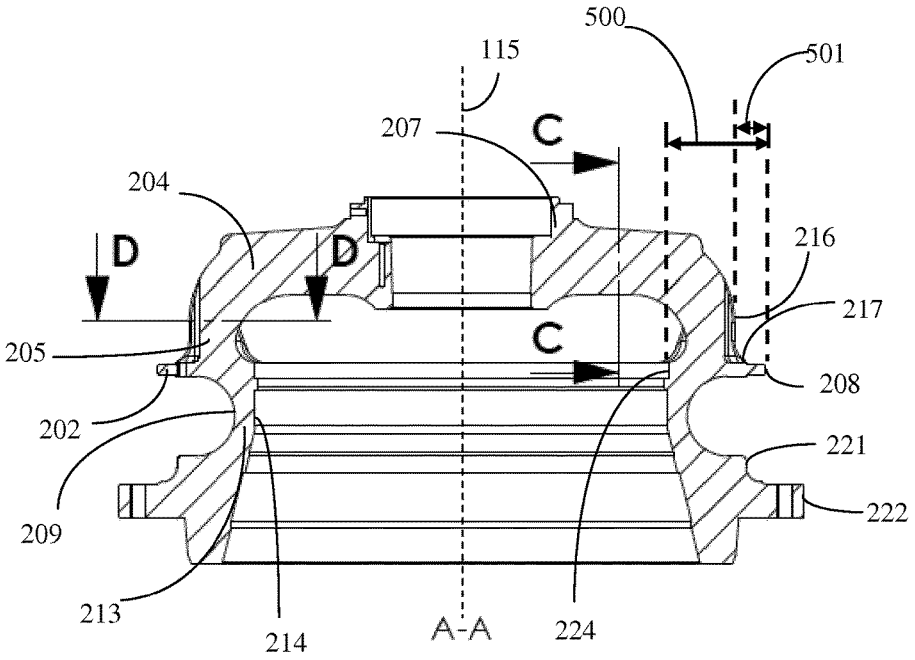
FIG. 5 is a cross-sectional side view through A-A of the spider and topshell assembly of FIG. 4.
Figure 7:
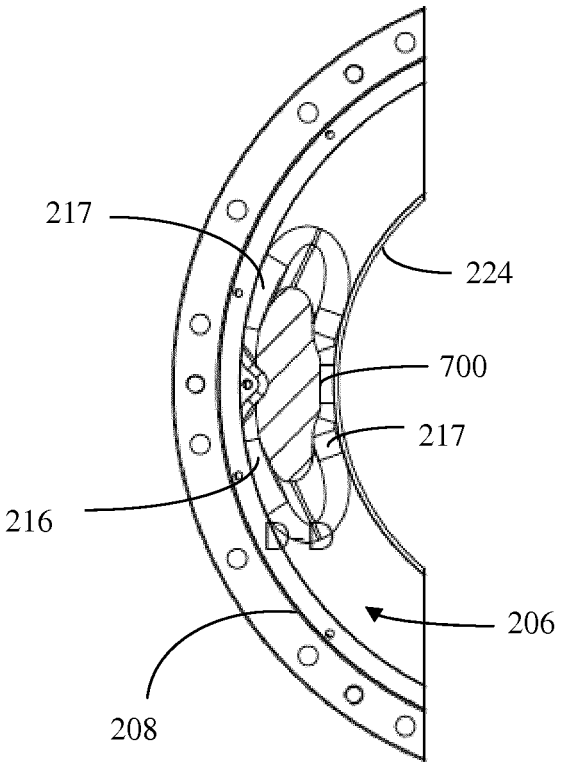
FIG. 7 is a part cross-sectional view through D-D of the spider arm and flange assembly of FIG. 5.

Referring to FIGS. 2, 3 and 7, second portion 205 extends from upper surface 206 of flange 202 inward of the outer circumferential perimeter 208 so as to create a spatial gap 300 between outer perimeter 208 and the radially outermost surface 216. Accordingly, the majority of the second portion 205 that extends in the axial direction and upwardly from upper surface 206 is aligned to be substantially central above upper surface 206. Accordingly, a corresponding spatial gap 301 is created between the inner circumferential perimeter 224 and radially inward facing surface 700. Referring to FIG. 5 in particular, the radially outermost region 216 of each arm 203 is positioned radially inward of outer perimeter 208 by a distance 501 that is substantially 20% to 30% of the radial distance 500 between the inner 224 and outer 208 circumferential perimeters.

Figure 6:
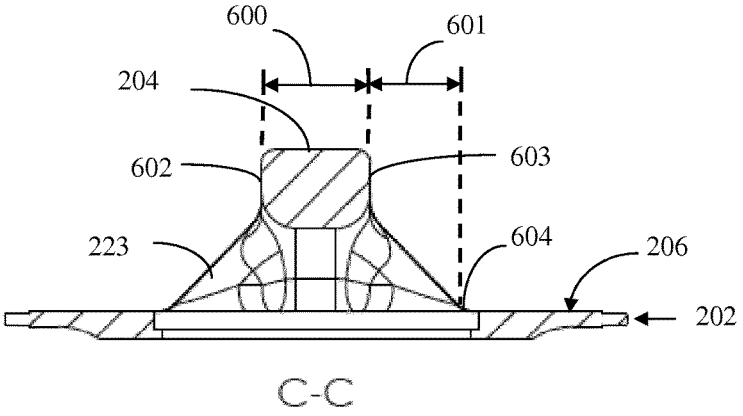
FIG. 6 is a part cross-sectional view through C-C of the spider arm and flange assembly of FIG. 5.

FIG. 6 illustrates selected relative dimensions of each wing 223. In particular, a distance 600 between first and second edges 602, 603 of first portion 204 in a plane perpendicular to axis 115 is substantially equal to a distance 601 over which each wing 223 tapers outwardly from first portion 204 to a region of contact 604 with upper surface 206. As each wing 223 is aligned along the circumferential path followed by flange 202, the wings 223 extends from second portion 205 in an angled alignment over surface 206. Due to the combined circumferential length of the wings 223, a circumferential length or distance by which the arm second portion 205 extends over the flange surface 206 substantially in the annular circumferential direction of flange 202 is greater than a corresponding radial thickness of the arm second portion 205 in the direction between flange perimeters 224 and 208. This configuration serves to further spread the loading forces in a direction along the circumferential path the flange 202.

Figure 4:
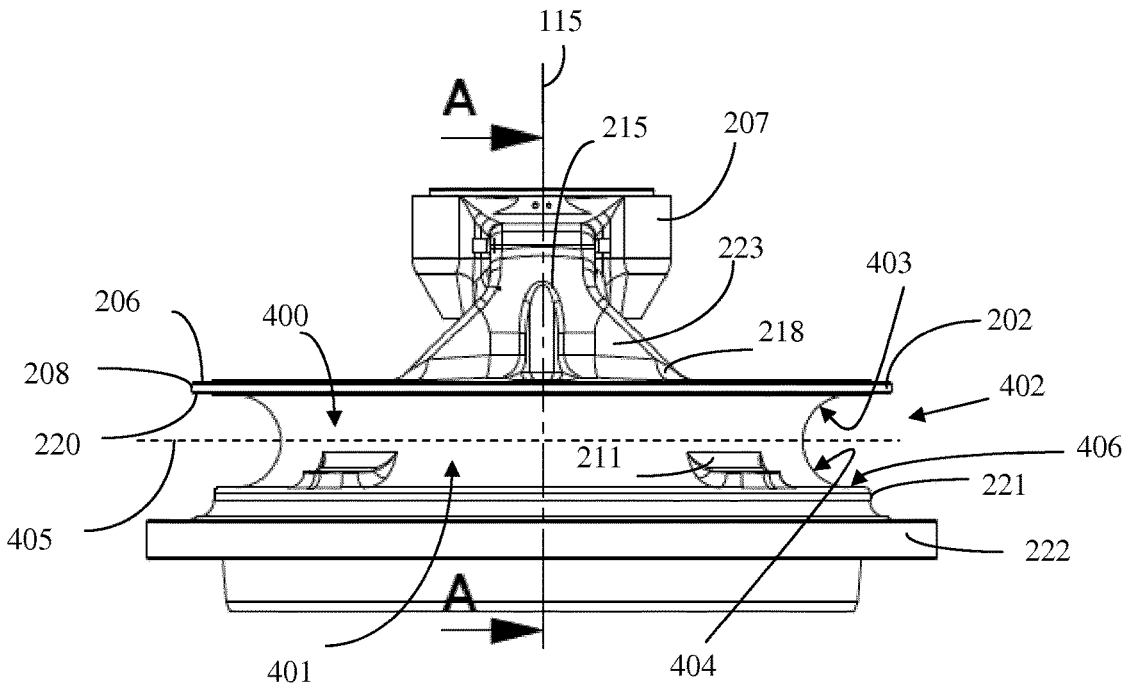
FIG. 4 is an external side view of the spider and topshell assembly of FIG. 3.

Referring to FIG. 4, the walls 213 of topshell 200, positioned axially below flange 202, comprises a concave profile 402 at their outer surface 209. Curved profile 402 extends continuously in the axial direction 115 between underside surface 220 of flange 202 and lower flange 221. This concave region 402 may be considered to comprise an upper first half 400 and a lower second half 401 relative to axial direction 115, with each half 400, 401 separated by bisecting line 405 shown only for descriptive purposes. The first half 400 is positioned immediately below flange 202 and extends from lower surface 220.

Similarly, second half 401 is positioned immediately above lower flange 221 and extends from an upper surface 406 of flange 221. The first and second halves 400, 401 interface with one another in the axial direction so as to define a substantially uniform curve in which the curve profile, in the axial direction 115 extends continuously between opposed surfaces 220 and 406.

Four notches 211 extend radially outward from the outer facing surface of lower half 401 at discrete regions evenly distributed in a circumferential direction around half 401. Notches 211 define wall sections having a flat base (or cap) and are configured to accommodate anchorage bolts or screws at the internal chamber side 212 of topshell 200.

With the exception of the notch regions 211, a curved shape profile 404 of lower half 401 is identical to a corresponding curved shape profile 403 of upper half 400. Accordingly, the curvature in the axial direction between surface 220 and surface 406 is symmetrical about the central bisecting plane 405 that extends perpendicular to axis 115.

The curve profile 403 at upper half 400, immediately below flange 202 comprises a substantially uniform curve extending continuously in the circumferential direction around axis 115 immediately below flange 202 and in particular downward facing surface 220. This endless curve 403 is devoid of support ribs or shoulders that would otherwise be positioned immediately below each spider arm 203 and extend axially below surface 220 according to known topshell and spider assemblies. Accordingly, the continuous, endless or uninterrupted curved profile 403 transits uniformly any loading forces through topshell 200 from spider arms 203. Accordingly, stress concentrations that would otherwise be created by the axial support shoulders of the known assemblies, is avoided. Furthermore, the present topshell 200 and spider 201 assembly is of reduced weight with regard to these known assemblies.

The curve profile 403, 404 that extends in the axial direction between surfaces 220 and 406 defines a semi-circular concave region 402 in which the curve extends over substantially 180° in the axial direction 115. As indicated, this curve in interrupted at lower half 401 by the discrete notch regions 211. However, other than regions 211, this curve profile 403, 404 is endless, continuous and uniform in the circumferential direction around axis 115 between flanges 202, 211. That is, the outward facing surface 209 between flanges 202, 211 is continuously curved in the axial direction 115 and is devoid of any axially straight or linear regions.

Referring to FIG. 5, the majority of lower portion 205 of each arm 203 is located axially above the concave region 402. In particular, curve profile 403 at upper half 400 curves radially outward towards surface 220 such that an appropriate mass of wall 213 is positioned immediately below the lower portion 205 of each arm 203. Accordingly, loading forces are transmitted through arms 203 and into the topshell 200 with such forces being effectively distributed circumferentially around topshell walls 213 with no or minimal stress concentration creation at the junction between spider 201 and topshell 200. The curve profile 404 at lower half 401 further facilitates uniform circumferential distribution of loading forces into the axially lower regions of topshell 200 and in particular the annular seating collar 222.

The invention claimed is:

1. A gyratory crusher frame part comprising:

a topshell mountable upon a bottom shell, the topshell having an annular wall extending around a longitudinal axis of the frame part, the topshell including an outward facing surface and an inward facing surface relative to the longitudinal axis, the annular wall being defined between the outward and inward facing surfaces;

a spider having a plurality of arms formed integrally with the topshell and extending radially outward from a cap positioned at the longitudinal axis, each arm of the plurality of arms having a first portion extending in a radially outward direction from the cap and a second portion extending in an axial direction from an outer region of the first portion; and an annular flange positioned between the second portion of each arm and the annular wall, the flange having an outer circumferential perimeter and an inner circumferential perimeter relative to the longitudinal axis, wherein a radially outermost region of the second portion of each arm is positioned radially inward of the outer circumferential perimeter of the flange, the annular wall including a concave section at the outer surface, the concave section having an upper first half and a lower second half along the axial direction, the upper first half of the concave section being positioned immediately below the annular flange and extending from a lower surface of the flange, wherein the upper first half of the concave section is a substantially uniform curve extending continuously in the circumferential direction and completely around the longitudinal axis, the upper first half of the concave section in the axial direction closest to the flange being devoid of any axially extending shoulders that would otherwise interrupt the continuous circumferential curve and a majority of the lower second half of the concave section in the axial direction including a curvature profile substantially equal to a curvature profile of the upper first half in the axial direction, and the second portion of each arm including a pair of wings that taper outwardly in the axial direction from the first portion to the annular flange, each wing of the pair of wings extending substantially in the circumferential direction with the flange.

2. The frame part as claimed in claim 1, wherein the radially outermost region of the second portion of each arm is positioned radially inward of the outer circumferential perimeter by a distance in the range 5 to 50% of the radial distance between the inner and outer circumferential perimeters of the flange.

3. The frame part as claimed in claim 1, wherein the radially outermost region of the second portion of each arm is positioned radially inward of the outer circumferential perimeter by a distance in the range 15 to 35% of a radial distance between the inner and outer circumferential perimeters of the flange.

4. The frame part as claimed in claim 1, wherein the radially outermost region of the second portion of each arm is positioned radially inward of the outer circumferential perimeter by a distance in the range 20 to 30% of a radial distance between the inner and outer circumferential perimeters of the flange.

5. The frame part as claimed in claim 1, wherein the outer surface of the wall at the concave section comprises a curvature extending over the range 170° to 185° in the axial direction.

6. The frame part as claimed in claim 1, wherein the flange extends directly from one end of the concave section such that one end of the curved outer surface terminates at the outer perimeter of the flange.

7. The frame part as claimed in claim 1, wherein the outward facing surface at the concave section comprises a curve extending continuously in the axial direction over the first half and the second half.

8. The frame part as claimed in claim 1, wherein each wing of the pair of wings is aligned to extend substantially in the circumferential direction with the flange, a distance in the circumferential direction by which each wing of the pair of wings tapers outwardly being substantially equal to a thickness of the first portion of each arm extending in a plane perpendicular to the longitudinal axis.

9. The frame part as claimed in claim 1, wherein each wing of the pair of wings is aligned to extend substantially in the circumferential direction with the flange a circumferential length by which the second portion extends over the flange substantially in the circumferential direction being greater than a corresponding radial thickness of the second portion in the direction between the inner and outer perimeters.

10. The frame part as claimed in claim 1, wherein an outward facing part of the second portion of each arm is flared radially outward and an inward facing part of the second portion of each arm is flared radially inward at a region of contact with the annular flange, the second portion of each arm being flared circumferentially outward such that a cross sectional area of the second portion of each arm increases in the axial direction from the first portion to the flange.

11. A gyratory crusher having a frame part, the frame part comprising:

a topshell mountable upon a bottom shell, the topshell having an annular wall extending around a longitudinal axis of the frame part, the topshell including an outward facing surface and an inward facing surface relative to the longitudinal axis, the annular wall being defined between the outward and inward facing surfaces;

a spider having a plurality of arms formed integrally with the topshell and extending radially outward from a cap positioned at the longitudinal axis, each arm of the plurality of arms having a first portion extending in a radially outward direction from the cap and a second portion extending in an axial direction from an outer region of the first portion; and an annular flange positioned between the second portion of each arm and the annular wall, the flange having an outer circumferential perimeter and an inner circumferential perimeter relative to the longitudinal axis, wherein a radially outermost region of the second portion of each arm is positioned radially inward of the outer circumferential perimeter of the flange, the annular wall including a concave section at the outer surface, the concave section having an upper first half and a lower second half along the axial direction, the first half of the concave section being positioned immediately below the annular flange and extending from a lower surface of the flange, wherein the upper first half of the concave section is a substantially uniform curve extending continuously in the circumferential direction and completely around the longitudinal axis, the upper first half of the concave section in the axial direction closest to the flange being devoid of any axially extending shoulders that would otherwise interrupt the continuous circumferential curve and a majority of the lower second half of the concave section in the axial direction including a curvature profile substantially equal to a curvature profile of the upper first half in the axial direction, and the second portion of each arm including a pair of wings that taper outwardly in the axial direction from the first portion to the annular flange, each wing of the pair of wings extending substantially in the circumferential direction with the flange.

* * * * *